US006705897B2

(12) United States Patent
Chen et al.

(10) Patent No.: US 6,705,897 B2
(45) Date of Patent: Mar. 16, 2004

(54) REAR-END ELECTROMAGNETIC SHIELDING COMPONENT OF AN ELECTRONIC CONNECTOR

(75) Inventors: Li-Sen Chen, Kaohsiun (TW); Ben-Hwa Jang, Taipei (TW); Chao-Tsu Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/601,569

(22) Filed: Jun. 24, 2003

(65) Prior Publication Data

US 2003/0232539 A1 Dec. 18, 2003

Related U.S. Application Data

(62) Division of application No. 09/998,789, filed on Dec. 3, 2001, now Pat. No. 6,609,934.

(51) Int. Cl.[7] ..... H01R 13/648
(52) U.S. Cl. ..... 439/610
(58) Field of Search ..... 439/607–610

(56) References Cited

U.S. PATENT DOCUMENTS

| | | | |
|---|---|---|---|
| 4,653,836 | A | 3/1987 | Peele |
| 5,456,618 | A | 10/1995 | Nakamura |
| 5,725,395 | A | 3/1998 | Lee |
| 5,755,597 | A | 5/1998 | Panis et al. |
| 5,941,733 | A | 8/1999 | Lai |
| 5,954,542 | A | 9/1999 | Wu et al. |
| 6,059,607 | A | 5/2000 | Wilson |
| 6,142,828 | A | 11/2000 | Pepe |
| 6,231,392 | B1 | 5/2001 | Van Woensel |

*Primary Examiner*—Gary F. Paumen
(74) *Attorney, Agent, or Firm*—Birch, Stewart, Kolasch & Birch, LLP

(57) ABSTRACT

The invention is an electromagnetic shielding component for increasing the effect of electromagnetic shielding at the rear end of an electronic connector. The metal shield shell can be closely connected to the metal shield sheet of a cable through the design of many adjacent strip-like tentacles at the rear end of an electronic connector. Therefore, the assembly precision for the shield shell and the cable can be increased to produce a rear end electromagnetic shielding component with the advantages of easy assembly and prevention of electromagnetic wave leakage.

4 Claims, 6 Drawing Sheets

REAR-END ELECTROMAGNETIC SHIELDING COMPONENT OF AN ELECTRONIC CONNECTOR

This application is a divisional of co-pending application Ser. No. 09/998,789, filed on Dec. 3, 2001 now U.S. Pat. No. 6,609,934, the entire contents of which are hereby incorporated by reference and for which priority is claimed under 35 U.S.C. §120.

BACKGROUND OF THE INVENTION

1. Field of the Invention

The present invention relates to an electromagnetic shielding component for increasing the effect of electromagnetic shielding at the rear end of an electronic connector.

2. Related Art

The effect of electromagnetic disturbance is aggravated as the data transfer rate carried by an electronic connector is increased, so electronic connectors of different data transfer rates always have different electric safety standards applied to them.

It is a well-known art to use metal sheets or conductive material to hold an electronic connector and ground it to prevent electromagnetic waves from radiating out of the electronic connector.

In U.S. Pat. No. 5,755,597, the electronic connector comprises a cone-shaped shield at its rear end. The cone-shaped shield consists of two components, which are assembled with each other via screws to clamp the exterior wire at the rear end of an electronic connector. However, such a method of electromagnetic shielding utilizes too many components and is complicated to assemble.

In U.S. Pat. No. 5,954,542, there is another type of shield for use in a USB connector. The shield comprises two parts: a front shield for embracing the main body of the USB connector and a back shield for embracing the joint between the end of the USB connector and a cable. An assembly method such as hooking or clipping is still necessary for coupling the two parts. Moreover, the back shield consists of a tube member and a plate member, which is more difficult to manufacture.

In U.S. Pat. No. 6,059,607, the structure of a metal shield for the electronic connector as disclosed seems more complicated. There are several finger-like clamping members for surrounding and binding the cable at the rear end of an electronic connector. However, they are many gaps between those finger-like clamping members to reduce the shielding effect of electronic connector.

As for the electronic connector disclosed in U.S. Pat. No. 6,231,392, the metal shield comprises a pair of shields at both sides of the electronic connector and a back shield at the rear end of the electronic connector. These three shields are put together by joint members such as hooks and buckles located between the engaging edges. In addition to the relatively excessive constituent components, the invention is also complicated to assemble.

SUMMARY OF THE INVENTION

The main object of the invention is to provide an electromagnetic shielding component for use in an electronic connector, and especially an electromagnetic shielding component capable of enhancing the effect of electromagnetic shielding at the joint between the rear end of an electronic connector and a cable.

Another object of the invention is to provide an electromagnetic shielding component that is easy to assemble and manufacture.

The electromagnetic shielding component as disclosed in the invention is still made of metal sheets, but its novel feature is a plurality of strip-like tentacles included within the electronic connector. When the electronic connector is connecting to a cable, these tentacles will be squeezed to tightly close and hold the periphery of a cable with electric connection to the metal shield within the cable. Therefore, the rear end of the electronic connector and the cable can be tightly assembled with minimum clearance, preventing electromagnetic waves from radiating out.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given hereinbelow. However, the following description is for purposes of illustration only, and thus is not limitative of the invention, wherein.

DETAILED DESCRIPTION OF THE INVENTION

Figure 1:
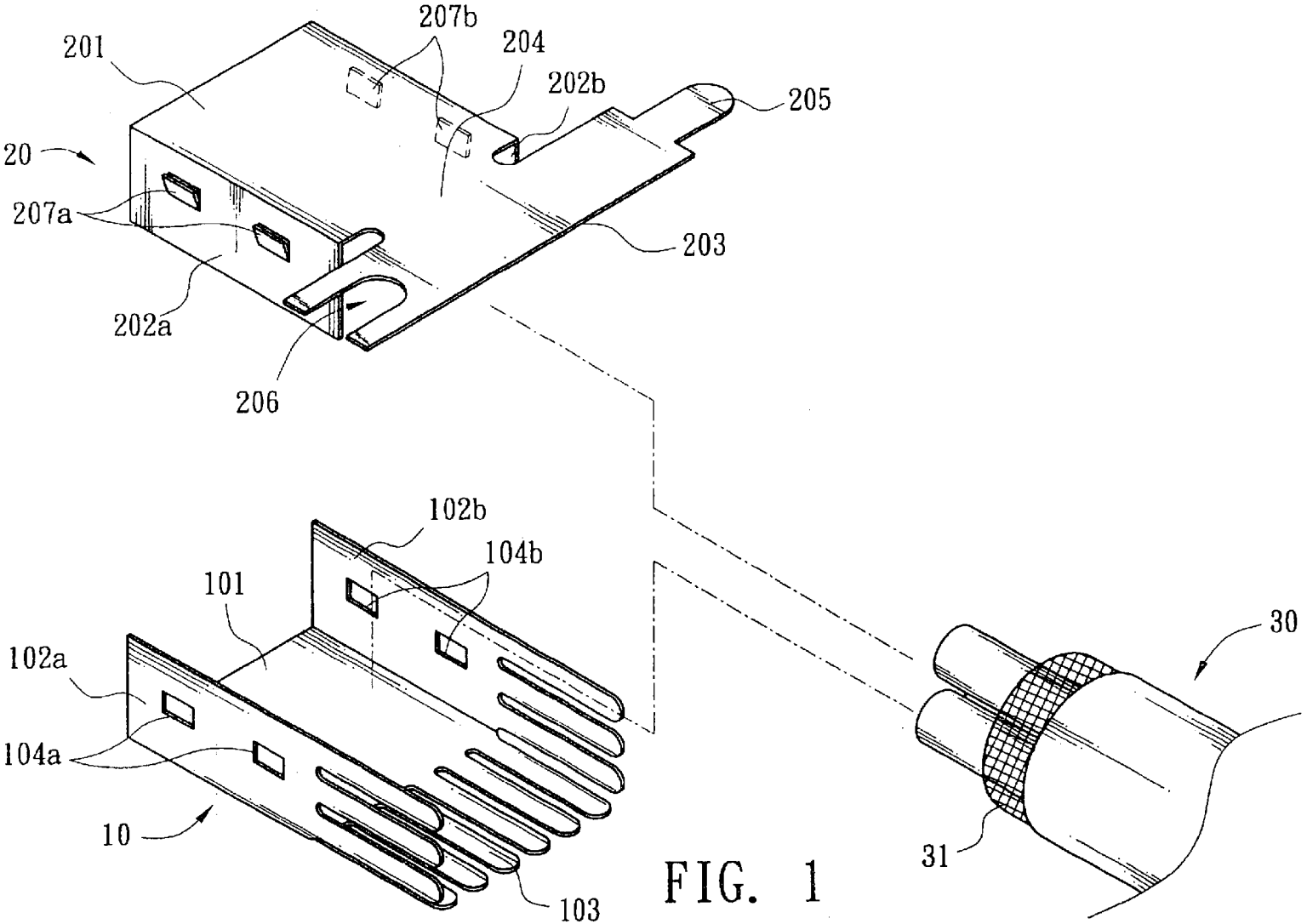
FIG. 1 is a construction drawing of the first embodiment of the invention showing the exploded structure for each component.
Figure 2:
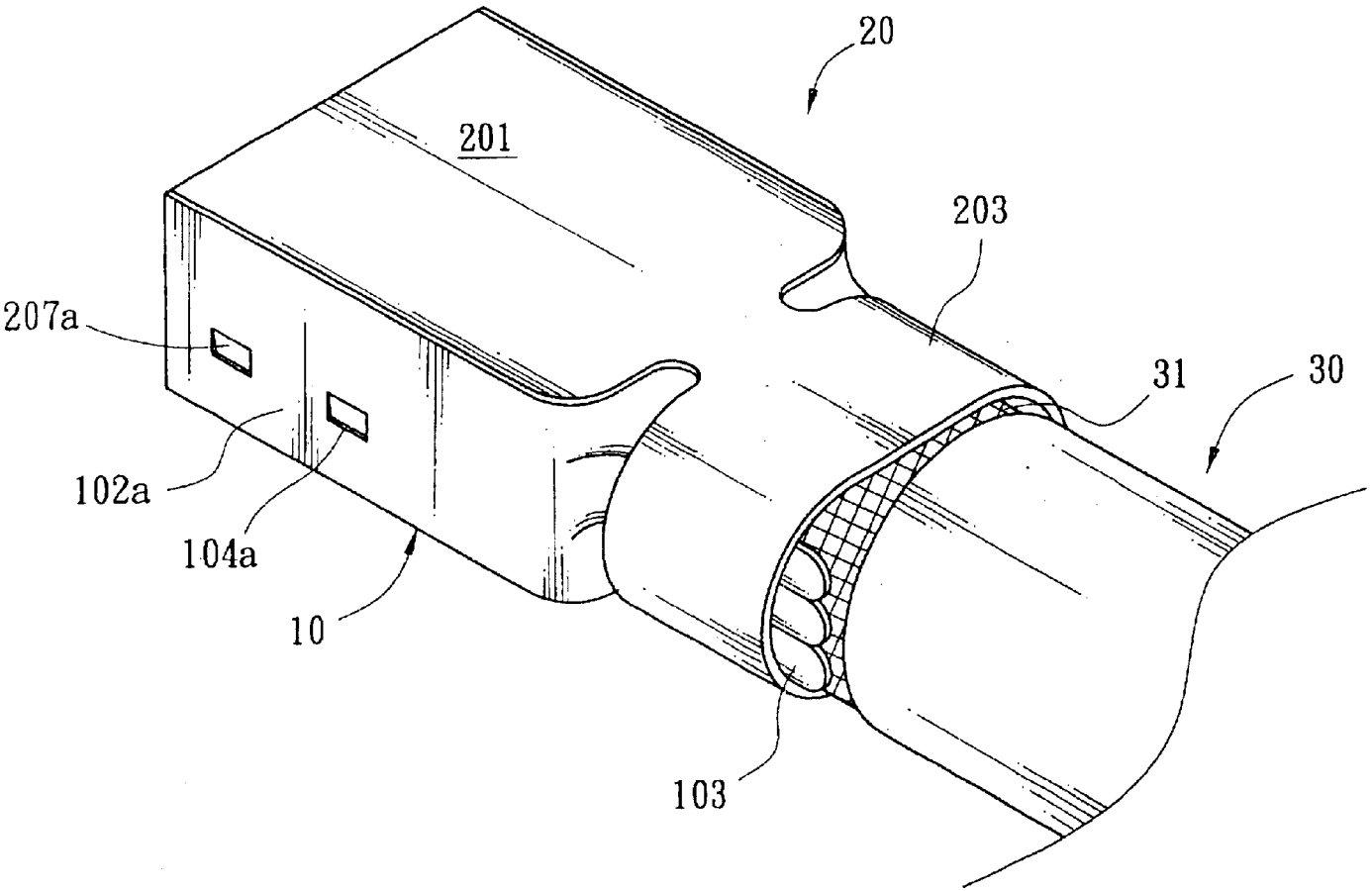
FIG. 2 is an assembly drawing according to FIG. 1, showing the combination of all components.

FIG. 1 shows the first preferred embodiment of the invention, wherein the electromagnetic shielding component mainly consists of two metal shield sheets combined to each other, and also comprises:

- a first shield sheet 10 made of sheet metal, comprising a bottom wall 101;
- a left wall 102*a* and a right wall 102*b*, both are engaged to the first shield sheet 10;
- a plurality of strip-like tentacles 103 extending from the first shield sheet 10 toward the cable 30;
- a plurality of left wall openings 104*a* and a plurality of right wall openings 104*b*; and a second shield sheet 20 made of sheet metal, comprising:
  - a top wall 201;
  - a left wall 202*a* and a right wall 202*b*, both of which are engaged to the top wall 201 and capable of fitting into the space between the left wall 102*a* and the right wall 102*b* of the first shield sheet, as shown in FIG. 2; they combine with each other through the buckling of a plurality of protruding members 207*a* and 207*b* lying on the left wall 202*a* and the right wall 202*b*, respectively, and a plurality of said left wall openings 104*a* and right wall openings 104*b*; and a constricting member 203 with a tongue member 205 in one end and a gap in the other, which is connected to the top wall 201 through a joint member 204 in the end thereof and extending along the axial direction of the cable 30.

As shown in FIG. 2, when the first shield sheet 10 and the second shield sheet 20 are combined with each other to hold an electronic connector (not shown in the drawings), only one's bare hands or a simple tool are needed to squeeze a plurality of strip-like tentacle 103 together to electrically ground the tentacles 103 and the metal shield sheet 31, such as a metal-woven web or an aluminum sheet inside the cable 30. Furthermore, the tentacles 103 can be tightly pressed to surround the periphery of the metal shield 31 by using the constricting member 203. In the meantime, the tongue member 205 and the gap 206 will be coupled together. Through the inventive design of strip-like tentacles, the assembly clearance at the joint of the cable and the rear end of an electronic connector can be minimized. This enhances the electromagnetic shielding effect.

Figure 3:
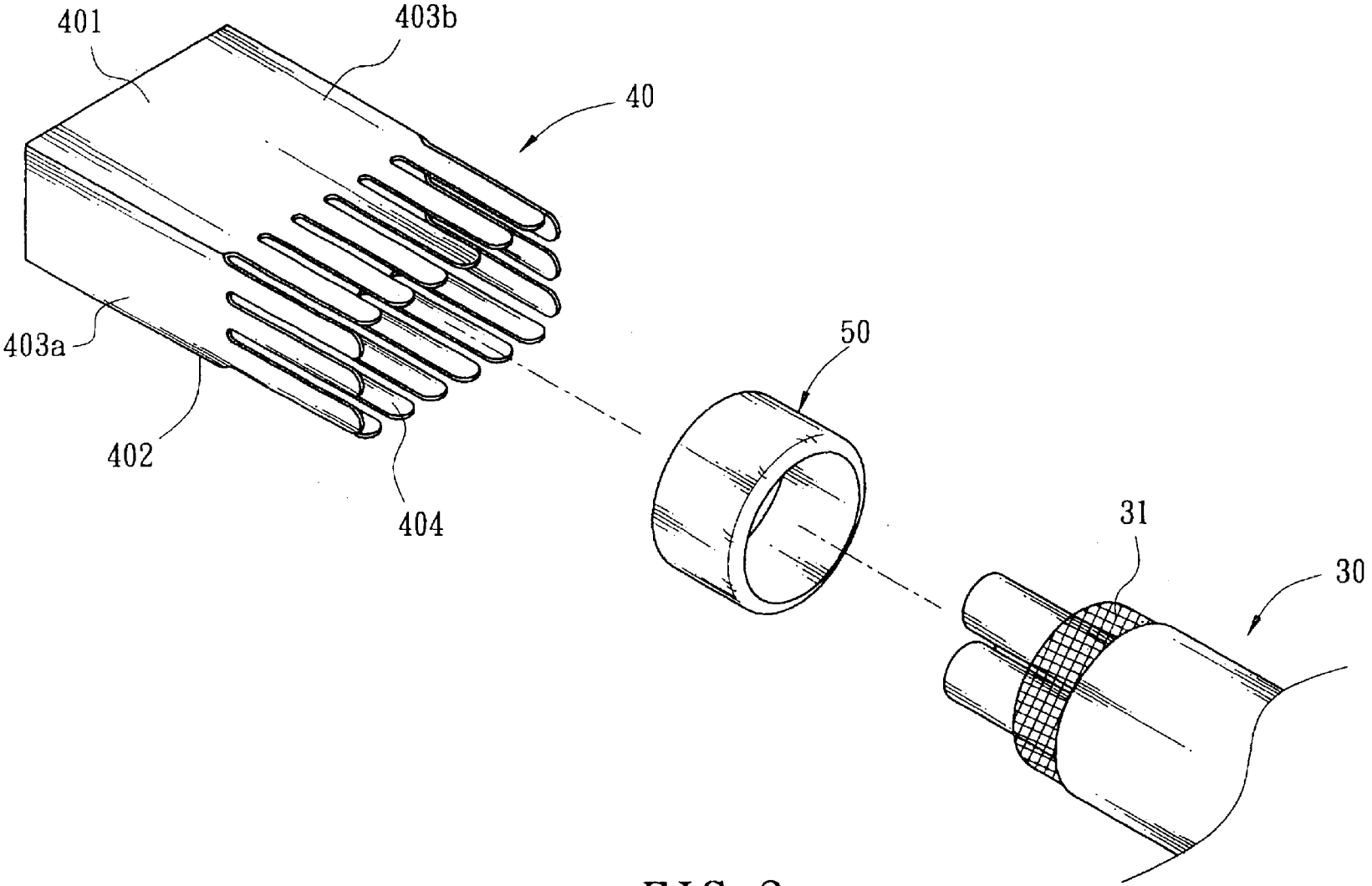
FIG. 3 is a construction drawing of the second embodiment of the invention showing the exploded structure for each component.

FIG. 3 illustrates the second preferred embodiment of the invention, wherein the electromagnetic shielding component comprises:

a tube shaped shield shell 40 made of thin sheet metal with a cross section dependent on the profile of the electronic connector, comprising a top wall 401, a bottom wall 402, a left wall 403*a*, and a right wall 403*b*, all of which are engaged to one another and comprise a plurality of strip-like tentacles 404 at their rear ends that extend toward the cable 30; and a tube shaped constricting ring 50 tightly onto the metal shield of said cable.

Figure 4:
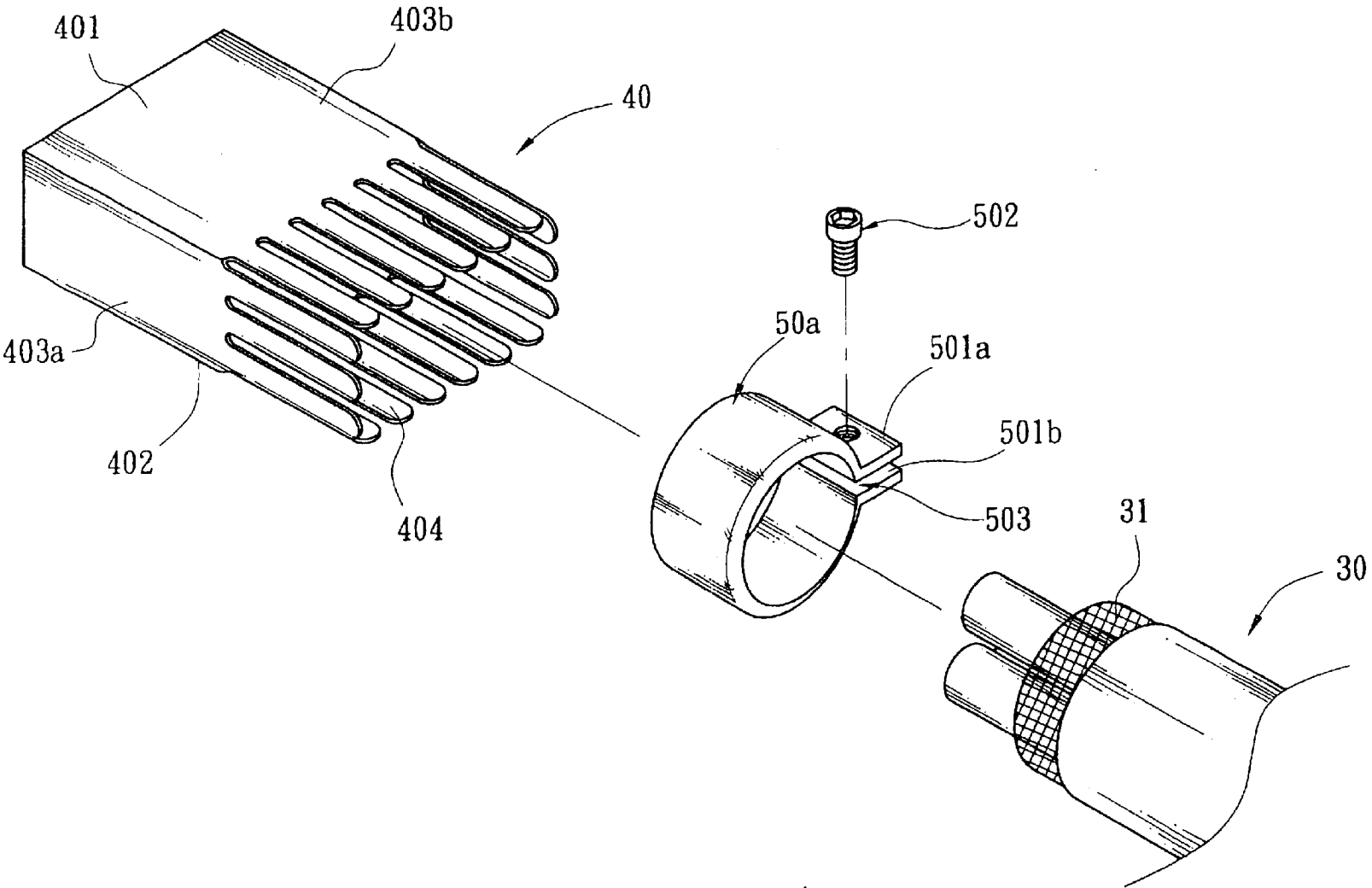
FIG. 4 is a construction drawing of the third embodiment of the invention showing the exploded structure for each component.
Figure 5:
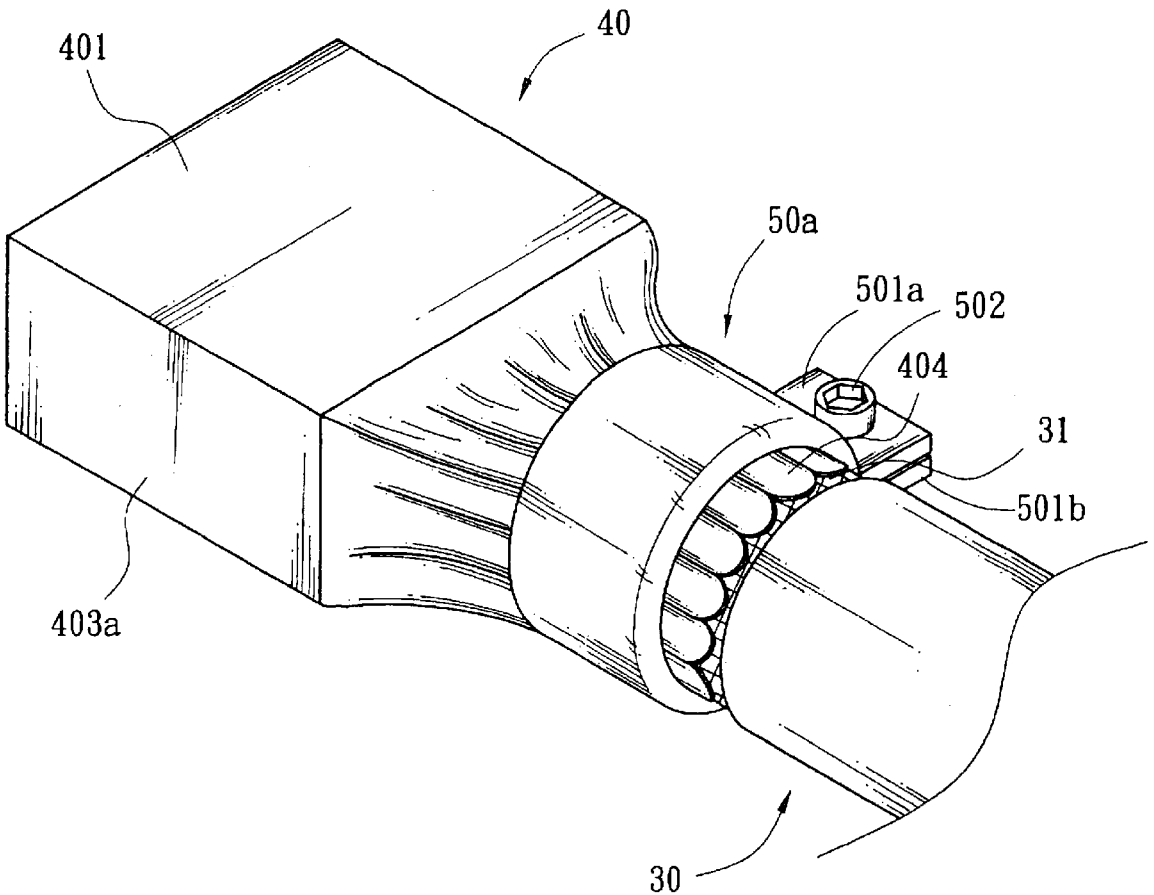
FIG. 5 is an assembly drawing according to FIG. 4, showing the combination of all components.

Further, the tube shaped constricting ring 50 could be a ring 50*a*, as shown in FIG. 4. The ring 50*a* comprising a lengthwise gap 503 with extending members 501*a* and 501*b* on either side thereof and the aforesaid strip-like tentacles 404 tightly constricted upon the metal shield sheet 31 of the cable 30, as shown in FIG. 5, by a constricting screw 502 clamping the extending members 501*a* and 501*b* together.

As shown in FIG. 3 and FIG. 4, the cross-section of the shield shell 40 is rectangular, which is different from that of a cylinder-shaped cable. However, the strip-like tentacles 404 can be easily constricted tightly together because of the sheet metal's malleability, which electrically grounds the tentacles 104 and the metal shield sheet 31, such as a metal-woven web or an aluminum sheet inside the cable 30.

Figure 6:
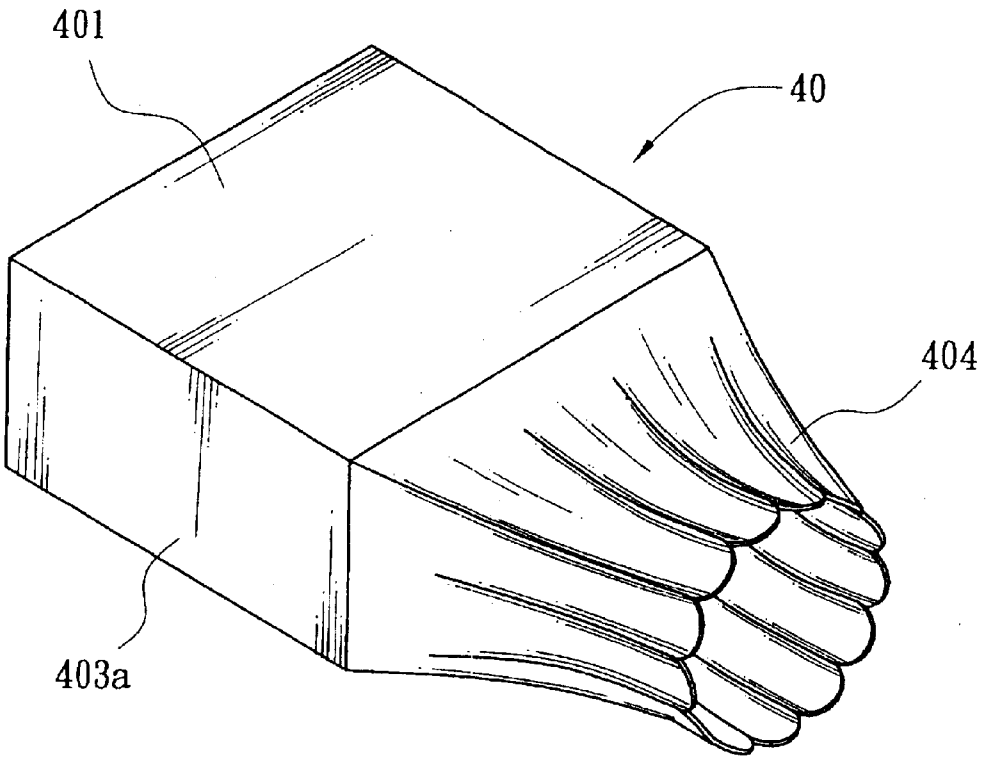
FIG. 6 is a construction drawing of the second embodiment of the invention, showing an alternative construction for the shield.

In another preferred embodiment as shown in FIG. 6, the strip-like tentacles 404 are formed circular shape when manufacturing the shield shell 40 using press molding. Such a method makes the tentacles 404 in the rear end of the shield shell 40 embrace the periphery of the cable 30 more closely with even less clearance to further enhance the electromagnetic shielding effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rear-end electromagnetic shielding component for enhancing the electromagnetic shielding effect at the joint between an electronic connector and a cable, comprising:

a shield shell of tube shape comprising a top wall, a bottom wall, a left wall, and a right wall, comprising a plurality of strip-like tentacles at rear ends of the walls that extend toward said cable; and a constricting ring of tube shape tightly squeezes the tentacles onto the metal shield of said cable.

2. The rear-end electromagnetic shielding component of a electronic connector as disclosed in claim 1, wherein the cross-section of said shield shell is dependent on the profile of said electronic connector.

3. The rear-end electromagnetic shielding component of a electronic connector as disclosed in claim 2, wherein the cross-section of said shield shell is rectangular.

4. The rear-end electromagnetic shielding component of a electronic connector as disclosed in claim 1, wherein said strip-like tentacles are formed in a circular shape.

* * * * *